US007595614B2

(12) United States Patent
Stich et al.

(10) Patent No.: US 7,595,614 B2
(45) Date of Patent: Sep. 29, 2009

(54) LOAD TAP CHANGER

(75) Inventors: Frederick A. Stich, Wisconsin Rapids, WI (US); James H. Harlow, Mentone, AL (US); William F. Griesacker, Moon Township, PA (US); Reshma Sharif, Pittsburgh, PA (US)

(73) Assignee: Pennsylvania Transformer Technology, Inc., Canonsburg, PA (US)

( * ) Notice: Subject to any disclaimer, the term of this patent is extended or adjusted under 35 U.S.C. 154(b) by 120 days.

(21) Appl. No.: 11/952,673

(22) Filed: Dec. 7, 2007

(65) Prior Publication Data

US 2009/0146637 A1 Jun. 11, 2009

(51) Int. Cl.
*G05F 1/147* (2006.01)

(52) U.S. Cl. ..... 323/256

(58) Field of Classification Search ..... 323/264, 323/255, 256, 257, 258
See application file for complete search history.

(56) References Cited

U.S. PATENT DOCUMENTS

| | | | | |
|---|---|---|---|---|
| 3,109,975 | A * | 11/1963 | Jacobsen | 323/256 |
| 3,437,913 | A | 4/1969 | Matzl et al. | |
| 3,466,530 | A | 9/1969 | Matzl et al. | |
| 3,502,961 | A | 3/1970 | Matzl et al. | |
| 3,534,246 | A | 10/1970 | Matzl et al. | |
| 3,710,232 | A | 1/1973 | Matzl | |
| 3,728,611 | A | 4/1973 | Elvin | |
| 3,786,337 | A | 1/1974 | Kugler | |
| 4,220,911 | A | 9/1980 | Rosa | |
| 4,301,489 | A | 11/1981 | Stich | |
| 4,363,060 | A | 12/1982 | Stich | |
| 4,550,285 | A | 10/1985 | Kugler et al. | |
| 4,622,513 | A | 11/1986 | Stich | |
| 5,006,784 | A | 4/1991 | Sonntagbauer | |
| 5,694,034 | A | 12/1997 | Dohnal et al. | |
| 5,773,970 | A | 6/1998 | Dohnal et al. | |

FOREIGN PATENT DOCUMENTS

GB 1300860 A 12/1972

OTHER PUBLICATIONS

Shuttleworth, et al., "New Tap Changing Scheme", IEE Proceedings: electrical Power Applications, Institution of Electrical Engineers, Jan. 8,1996, vol. 143, No. 1, pp. 108-112.
Harlow, et al., "An Arcless Approach to Step-Voltage Regulation", IEEE PES 1981 Transmission and Distrbution Conference and Exposition, Minneapolis, Minnesota, Sep. 20-25, 1981.

* cited by examiner

*Primary Examiner*—Shawn Riley
(74) *Attorney, Agent, or Firm*—Pepper Hamilton LLP

(57) ABSTRACT

A load tap changer includes a single mechanical switch that is movable to create, in a first position, a first conducting path between a first transformer tap and a load. When the switch is in a second position, the switch creates a second conducting path between a second transformer tap and the load. A first thyristor pair or other device creates a first alternate conducting path between the first transformer tap and the load when the switch is disengaged from the first position. A second thyristor pair or other device creates a second alternate conducting path between the second transformer tap and the load when the mechanical switch is disengaged from the second position. Each thyristor pair may be selectively triggered to provide a conducting path when voltage across either thyristor pair exceeds a predetermined level. A gate trigger circuit may be included for each thyristor pair, and a gate control circuit may control each of the gate trigger circuits.

20 Claims, 9 Drawing Sheets

LOAD TAP CHANGER

CROSS-REFERENCE TO RELATED APPLICATIONS

Not applicable.

STATEMENT REGARDING FEDERALLY SPONSORED RESEARCH

Not applicable.

NAMES OF PARTIES TO A JOINT RESEARCH AGREEMENT

Not applicable.

SEQUENCE LISTING

Not applicable.

BACKGROUND

1. Technical Field

The disclosed embodiments generally relate to the field of voltage regulating or control systems. More particularly, the disclosed embodiments relate to an improved tap changing method and system for power delivery.

2. Description of the Related Art

A tap changer is a device used to change the load voltage or phase angle of a power delivery system. Typically, the selection of a tap adjusts the number of turns used in one or more of a transformer's windings. Tap changers most commonly are used to permit the regulation of the output voltage of a transformer or step voltage regulator to a desired level.

Tap changing may occur either while the transformer is energized (i.e., under load) or while the transformer is not energized (i.e., offline). A mechanical switching assembly is typically used to accomplish tap changing under load (TCUL) in power transformers and step-voltage regulators. To accomplish a tap change, older design load tap changers (LTCs) simply interrupt the load current, which is sometimes more than 1,000 amperes, with the simple parting of contacts under oil. This practice continues today.

The interruption of a high load current can lead to an arc between the contacts. To avoid this arc and the consequential deleterious effects of contact burn and oil decomposition, which leads to early failure or the need for maintenance, newer tap changers include contacts that are immersed in oil with the inclusion of a vacuum switch. In these designs, the current is commutated to a path through the vacuum switch for the current interruption. An early description of such a design, which is still commonly used today, is found in H. A. Fohrhaltz, *Load-Tap Changing with Vacuum Interrupters*, IEEE Transactions on PAS, vol. PAS-86, No. 4, April 1967, pp. 422-428. Vacuum switch technologies usually require the use of bridging reactors. The bridging reactor is itself a transformer, of perhaps one quarter of the size of the main transformer. It significantly adds to the cost and weight of the total assembly. It typically will also add to total internal losses, the resulting heat having to be dissipated with additional tank cooling provisions.

Various attempts have been made to replace the vacuum switch in a LTC with power thyristors. Some of these attempts can be categorized as "solid-state" technology, and the rest can be categorized as "hybrid" technology. Solid state LTCs can be characterized by the elimination of any mechanical switching assembly. The motivation is very high speed operation, i.e., one to three cycles (typically less than 50 milliseconds), and the opportunity to span multiple tap steps in a single operation. This feature provides more speed than is typically required for run-of-the-mill power distribution transformer applications, which typically involve a 30 second intentional time delay. Thus, it often adds an unnecessary expense. In addition, reliability issues can be extensive since the thyristors must be continuously active. An illustrative early embodiment of a solid-state implementation is found in U.S. Pat. No. 3,195,038, issued Jul. 13, 1965 to Fry.

In contrast, "hybrid" technology includes both mechanical switches and solid-state components (e.g., thyristors). In these designs, mechanical switches accomplish the tap position selection, while the thyristors only assist during the actual tap change event, which will typically occur less than 40 times per 24 hours. Because the mechanical switch is doing the actual tap position selection, fewer thyristors are required. One implementation of a hybrid LTC is found in U.S. Pat. No. 4,363,060, issued Dec. 7, 1982 to Stich.

A problem with hybrid designs is that they involve the use of a means (usually a power resistor) to limit the magnitude of a current that may circulate in the electronic circuit during the tap change. Others have attempted to avoid such a need with the use of more complex (and expensive) circuitry and gate-turn-off thyristors. Prior hybrid systems also require multiple power switches, further adding to the cost of the circuit.

The disclosure contained herein describes attempts to address one or more of the problems described above.

SUMMARY

In an embodiment, a load tap changer includes a first semiconductor device connected to a first gate trigger circuit, a second semiconductor device connected to a second gate trigger circuit, and a mechanical switch. The mechanical switch shunts the first semiconductor device when the mechanical switch is in a first conducting position, and it shunts the second semiconductor device when the mechanical switch is in a second conducting position. The mechanical switch creates a first circuit between a source and a load through a first contact when the mechanical switch is in the first conducting position, and mechanical switch creates a second circuit between the source and the load through a second contact when the mechanical switch is in the second conducting position. Movement of the mechanical switch from the first conducting position to the second conducting position causes one of the gate trigger circuits to trigger its corresponding semiconductor device and momentarily complete a circuit through the corresponding semiconductor device for effecting engagement of a transformer tap.

Optionally, each semiconductor device may include one or more semiconductive components electrically connected as an alternating current switch, such as a thyristor pair. The first thyristor pair and the second thyristor pair may be the only thyristor pairs in the load tap changer that are required to change from the first circuit to the second circuit. In some embodiments, the triggering is responsive to the detection of current in one of the mechanical switch conducting positions by a gate control. The gate control may be a single gate control that controls both the first gate trigger circuit and the second gate trigger circuit. In addition, the mechanical switch may be the only mechanical switch in the circuit that is required to change from the first circuit to the second circuit.

In an alternate embodiment, a load tap changer includes a single mechanical switch that is movable to create, in a first position, a first conducting path between a first transformer tap and a load. When the switch is in a second position, the switch creates a second conducting path between a second transformer tap and the load. A first thyristor pair creates a first alternate conducting path between the first transformer tap and the load when the switch is disengaged from the first position. A second thyristor pair creates a second alternate conducting path between the second transformer tap and the load when the mechanical switch is disengaged from the second position. A gate trigger circuit may be included for each thyristor pair, and a gate control circuit may control each of the gate trigger circuits.

Optionally, in the above-described embodiment, a current limiting device may not be required to be electrically connected between the switch and either of the thyristor pairs. During long-term operation, each thyristor pair may receive substantially the same level of duty. In some embodiments, the mechanical switch may be a two-pole, single-throw switch. In addition to the mechanical switch, the changer also may include a Geneva wheel, a first moving contact, and a second moving contact. In such an embodiment, the Geneva wheel initiates movement of the first moving contact toward and away from the first transformer tap, and the Geneva wheel also initiates movement of the second moving contact toward and away from the second transformer tap. In some embodiments, the changer also may include a first snubber circuit that is electrically connected in parallel with the first thyristor pair, and a second snubber circuit that is electrically connected in parallel with the second thyristor pair.

In an alternate embodiment, a method of delivering power to a load includes operating a circuit having a mechanical switch in a first conducting position and a first moving contact in electrical connection with a first tap of a transformer, so that the mechanical switch and first moving contact create a first circuit between a source and a load. A second contact is moved to create an electrical connection between the second contact and a second tap of the transformer. The mechanical switch is moved away from the first conducting position and toward a second conducting position. A gate trigger circuit triggers a first semiconductor device to complete a circuit between the source and the load through the first semiconductor device. A second gate trigger circuit triggers a second semiconductor device to complete a circuit between the source and the load through the second semiconductor device. The first gate trigger circuit then removes the trigger from the first semiconductor device, which subsequently stops conducting. When the mechanical switch reaches the second conducting position, a second circuit is created between the source and the load by shunting the second semiconductor device and passing current through the mechanical switch. The method may maintain a level of current delivered to the load at a substantially constant level as the mechanical switch moves from the first conducting position to the second conducting position. The event of the first semiconductor device turning off may be responsive to a current zero through the mechanical switch. Triggering and conduction of the second semiconductor device may be responsive to detection of voltage across either the first semiconductor device or the second semiconductor device in excess of a peak voltage of a winding of the transformer.

DETAILED DESCRIPTION

Before the present methods, systems and materials are described, it is to be understood that this disclosure is not limited to the particular methodologies, systems and materials described, as these may vary. It is also to be understood that while all circuit descriptions reveal a single-phase implementation, the methods and systems described herein also include multi-phase applications. It is also to be understood that the terminology used in the description is for the purpose of describing the particular versions or embodiments only, and is not intended to limit the scope. For example, as used herein and in the appended claims, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

As used herein, the term "semiconductor device" means an electronic component made of semiconductive materials such as silicon, germanium or gallium arsenide. Examples of semiconductor devices include thyristors, which include at least four layers of alternating N-type and P-type materials and which act as a switch. A semiconductor device may also include a thyristor pair. Other examples include insulated gate bipolar transistors (IGBTs), or particular thyristor types such as gate turnoff (GTO) thyristors and silicon controlled rectifiers (SCRs).

As used herein, the term "connected" means electrically connected, either directly or via one or more intervening devices. The term "shunt" as used herein refers to the ability of a device to allow electrical current to pass around the device as a short circuit in parallel to one or more other devices.

Figure 1:
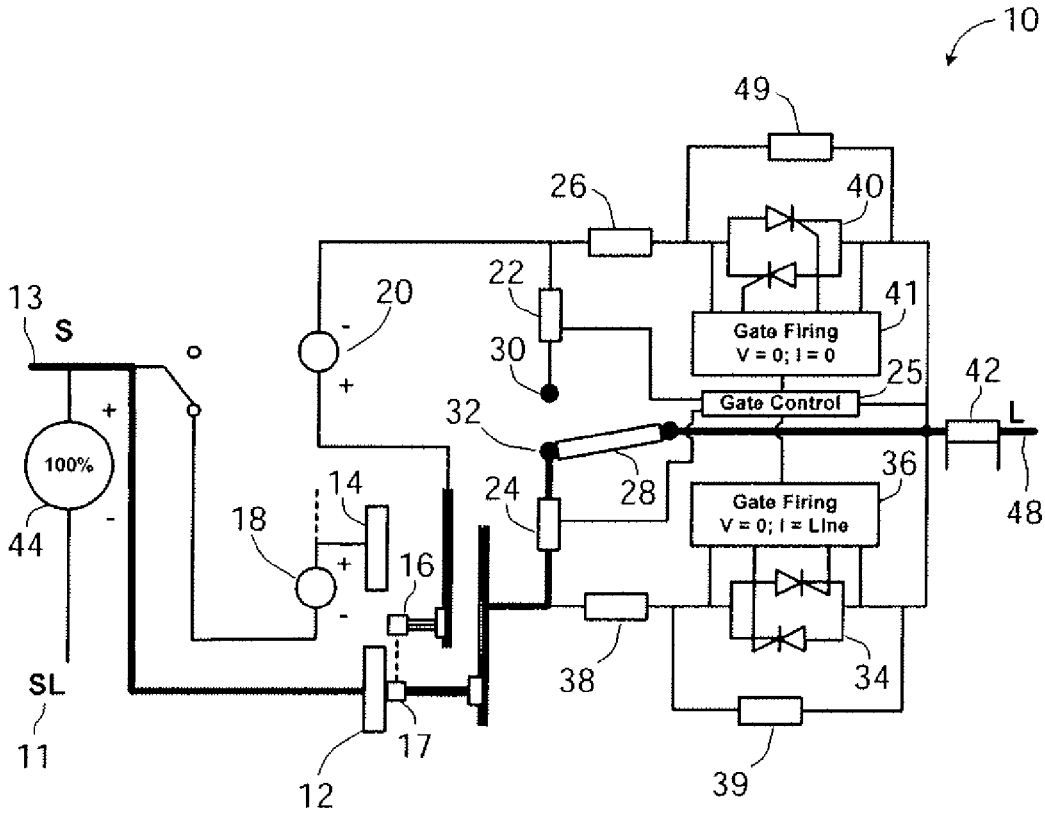
FIG. 1 illustrates an exemplary single phase regulator circuit in a quiescent state.

FIG. 1 illustrates an exemplary single phase regulator circuit 10 in a quiescent state. The circuit 10 regulates a voltage across a load (not illustrated, but connected between terminal 48 and terminal SL 11), which is commonly connected to ground. Stationary contacts 12, 14 are connected to taps on the series winding of the transformer, of which only one section 18 is shown. In the embodiment, each such tap section represents approximately one and one-quarter percent (1¼%) of line voltage, although other percentages are possible. The shunt winding 44 is excited, generally at about 100% of source or load voltage, although other voltage levels are possible. In a quiescent state, a circuit is made from a power source through terminal S 13, through neutral stationary contact 12 and a first moving contact 17, such as a finger or other shaped contact, through current transformer 24, switch 28 and optional current transformer 42. The first moving contact 17, bus bars, copper or aluminum wire and/or other conductive materials may make up the circuit. In the quiescent state, switch 28 may be a two-pole, single-throw switch that is in electrical contact with first pole 32.

Figure 2:
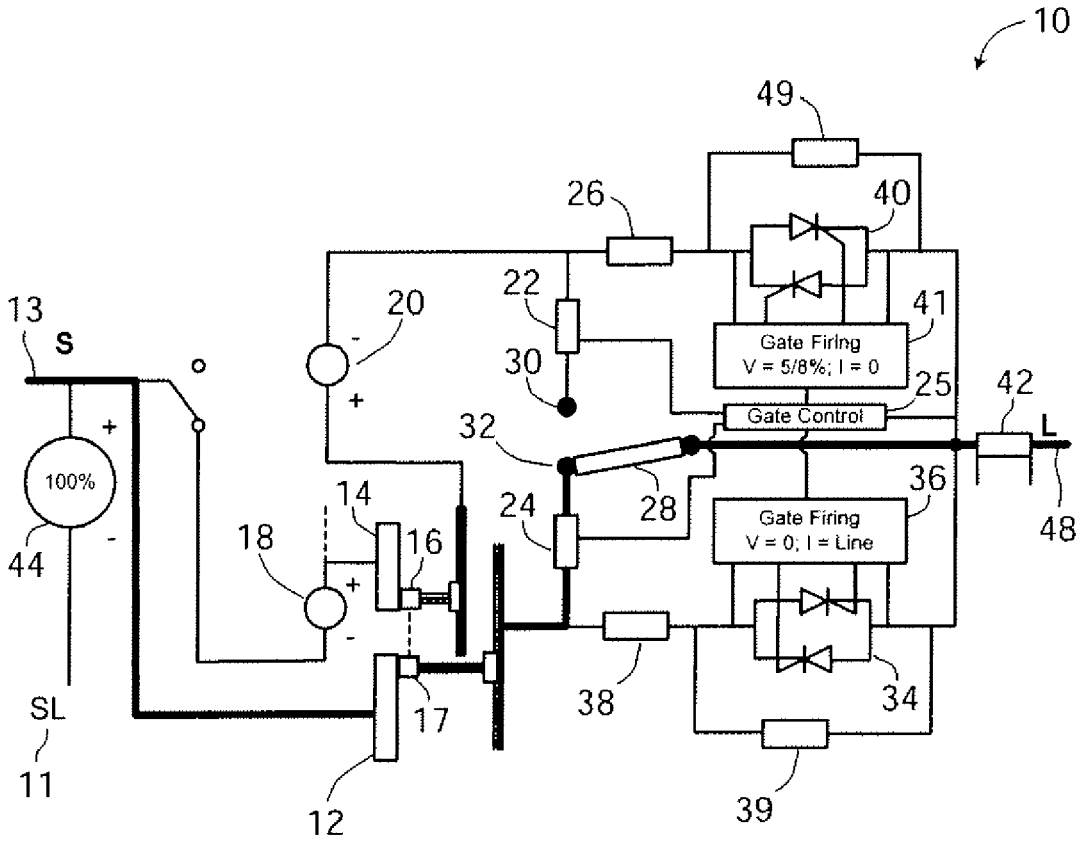
FIG. 2 illustrates an alternate position of the regulator circuit of FIG. 1.

Referring to FIG. 2, prior to full movement of the mechanical switch 28, a first semiconductor device 34 is gated on by the control signal derived from the current traveling through current transformer 24. Gate control 25 senses the current in current transformer 24 to initiate a gate signal at the first semiconductor device 34 after both moving fingers 16 and 17 make contact. Because the semiconductor device 34 is shorted by switch 28, first semiconductor device 34 is not conducting in the quiescent state. In the quiescent state, only one finger makes contact, and the semiconductor devices are not triggered. The semiconductor device is, in some embodiments, a thyristor pair as shown in FIG. 2. However, other semiconductor devices are possible. FIGS. 1 and 2 show an option in which a common gate control 25 controls both gate trigger circuits 36 and 41. However, separate gate controls for each gate trigger circuit may be used in alternate embodiments. Although not shown in the figures, gate control 25 may have electrical connections with one or both of pole 30 (and corresponding current transformer 22) and pole 32 (and corresponding current transformer 24). Gate control 25 also may make an electrical connection with load terminal 48.

The poles 30 and 32 of the mechanical switch 28 may have a relatively low voltage, such as approximately 50 to approximately 150 volts, across them at nominal distribution system voltages. However, the system line-to-ground voltage driving the load current through the switch 28 may be of a much higher voltage such as that used in the electrical power distribution system, including but not limited to common nominal voltages of about 7,200, about 14,400 or about 19,920 volts. A tap change sequence will include movement of the mechanical switch 28 from one pole position to the other along with tap switching to effect at least a substantially non-arcing tap transition while maintaining substantially continuous load current.

A Geneva wheel, sometimes known as a Geneva gear, or other mechanical means may be used to initiate movement of moving contacts 16 and 17 and mechanical switch 28. Second moving contact 16, such as a moving finger or other shaped contact, moves from a floating position (as shown in FIG. 1) to a bridging position (as shown in FIG. 2) to contact the series winding 18 at transformer tap 14. Thus, the ability for conduction of current from the source through terminal S 13 through windings 18 and 20 to load at terminal 48 is possible although in this step current does not yet flow through first thyristor pair 34, as switch 28 remains in contact with first pole 32. Thus, current passes through first current transformer 24 but not second current transformer 22, and thus the second semiconductor devices shown as a second thyristor pair 40 is gated off. Accordingly, in this step the load current passes through first pole 32 across switch 28 to the load terminal 48.

Figure 3:
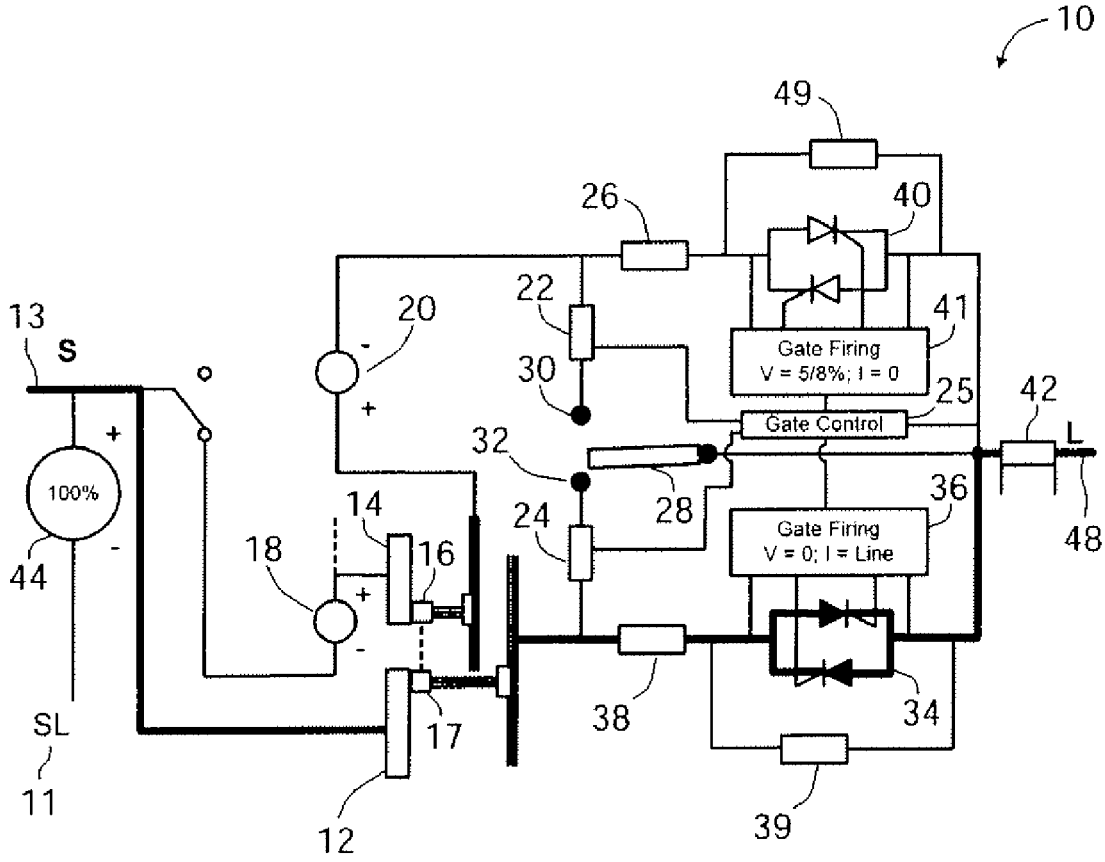
FIG. 3 illustrates an alternate position of the regulator circuit of FIG. 1.

In FIG. 3, switch 28 moves away from first pole 32 and towards second pole 30. First thyristor pair 34 may be gated on prior to movement of switch 28, as it is triggered by a gate trigger circuit 36 in response to the current in the current transformer 24 and the switch 28. Thyristor pair 34 will remain gated on until gate control 25 detects a current zero as measured at current transformer 24.

Figure 4:
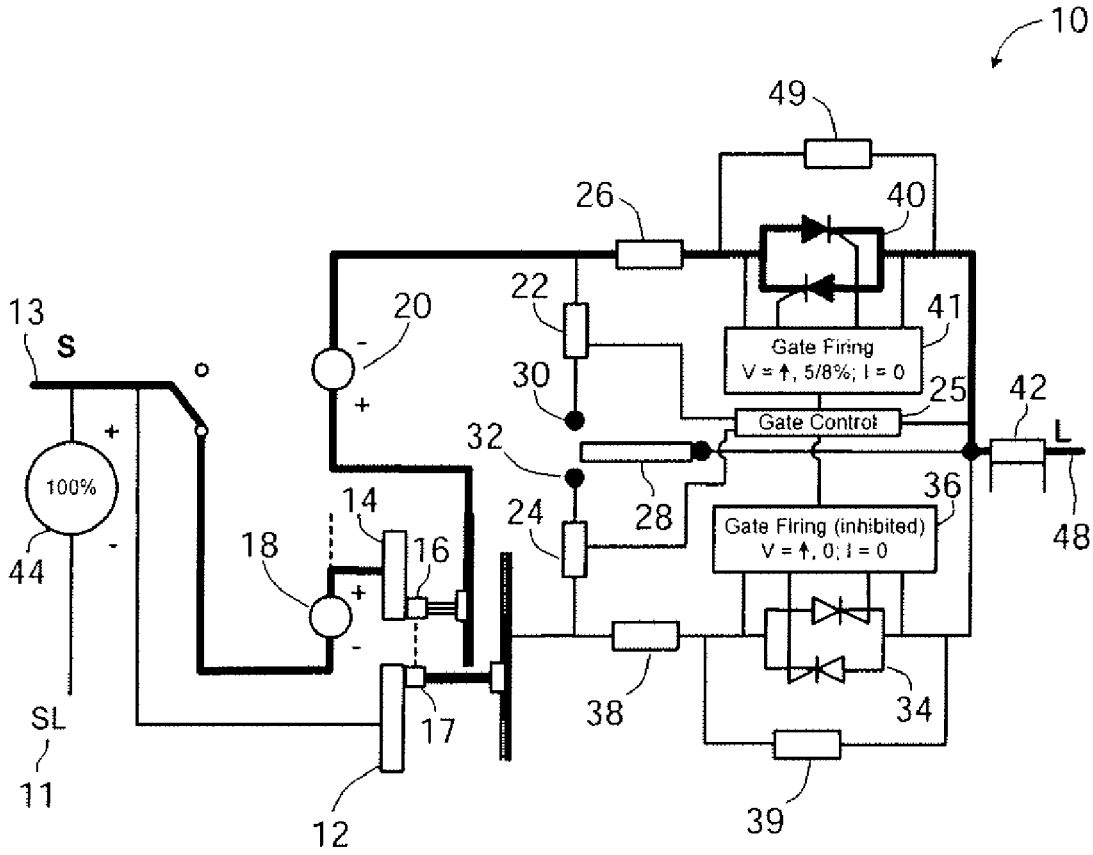
FIG. 4 illustrates an alternate position of the regulator circuit of FIG. 1.

Referring to FIG. 4, switch 28 then contacts neither of the poles 32 and 30. First thyristor pair 34 turns off at the next current zero after the gate signal is removed. The removal of the gate signal is controlled by the lack of current in pole 32 and may be instantaneous or after a predetermined delay. For a moment, conduction occurs through the snubbers 39 and 49. Voltage then builds across first thyristor pair 34 and second thyristor pair 40. When instantaneous voltage across either thyristor pair exceeds the normal peak operating voltage of winding 20 and winding 18 in series opposition by some predetermined margin, second thyristor pair 40 is gated into conduction, and current travels from source through S 13 to load through terminal 48 through second thyristor pair 40. The load path continues in a similar manner with a voltage triggering based on an amount which takes into account the maximum voltage that may appear on winding 20.

Figure 5:
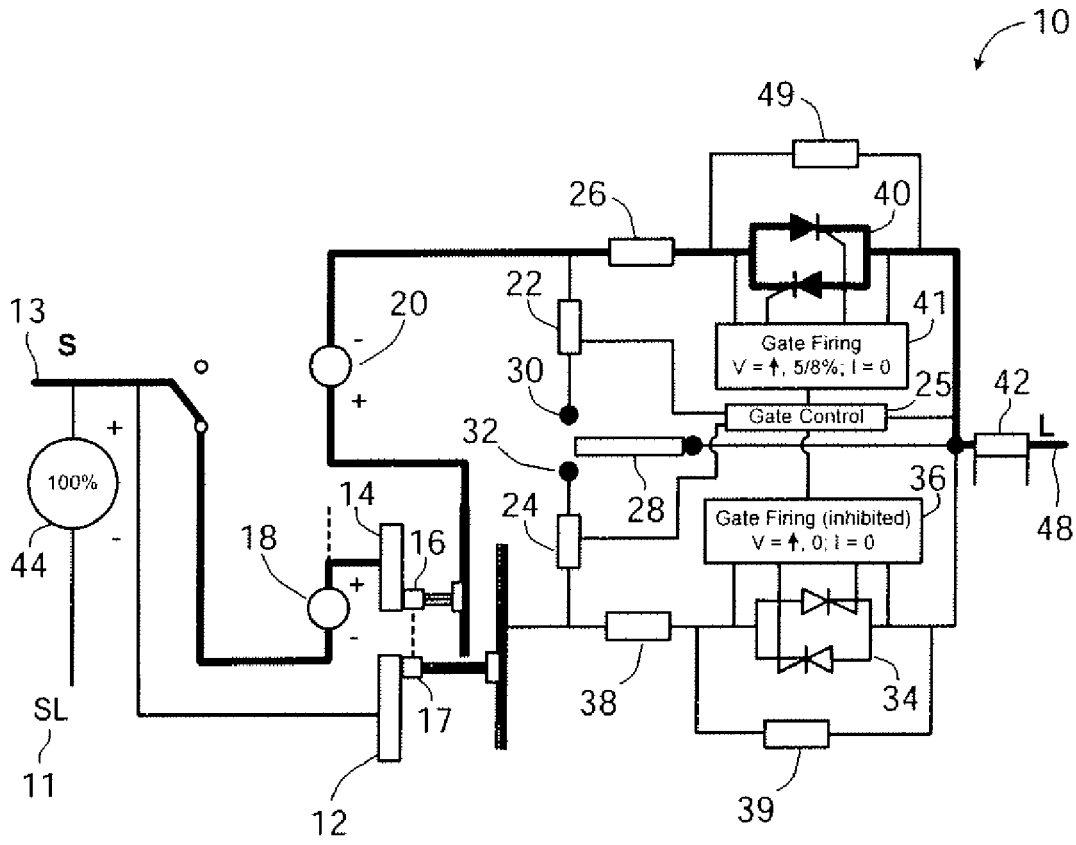
FIG. 5 illustrates an alternate position of the regulator circuit of FIG. 1.

Referring to FIG. 5, switch 28 moves toward second pole 30, and second thyristor pair 40 continues to carry the load until the switch electrically contacts second pole 30. When contact occurs, current path is through second pole 30, through switch 28 to load terminal 48. When electrical contact at second pole 30 is solid, the current is shunted away from second thyristor pair 40.

Figure 6:
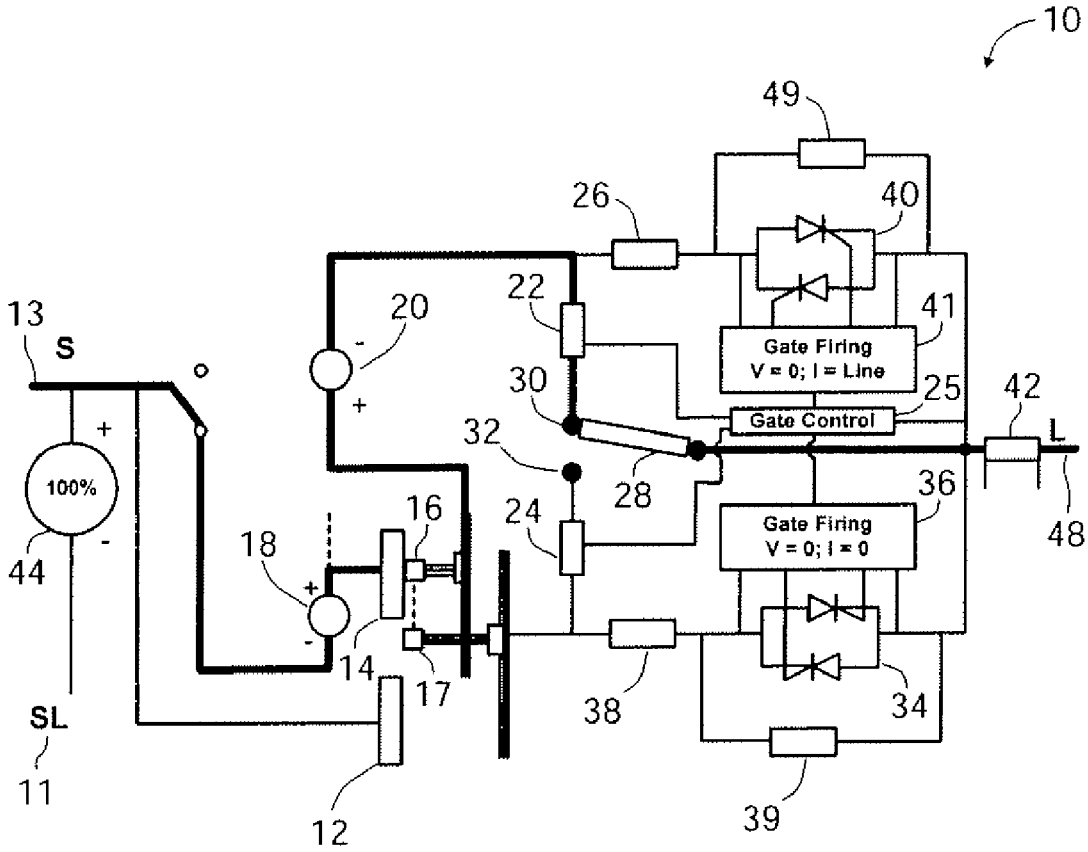
FIG. 6 illustrates an alternate position of the regulator circuit of FIG. 1.

At this point, referring to FIG. 6, as the Geneva wheel continues to move, the first moving contact 17 moves away from neutral position 12 to a floating position.

Figure 7:
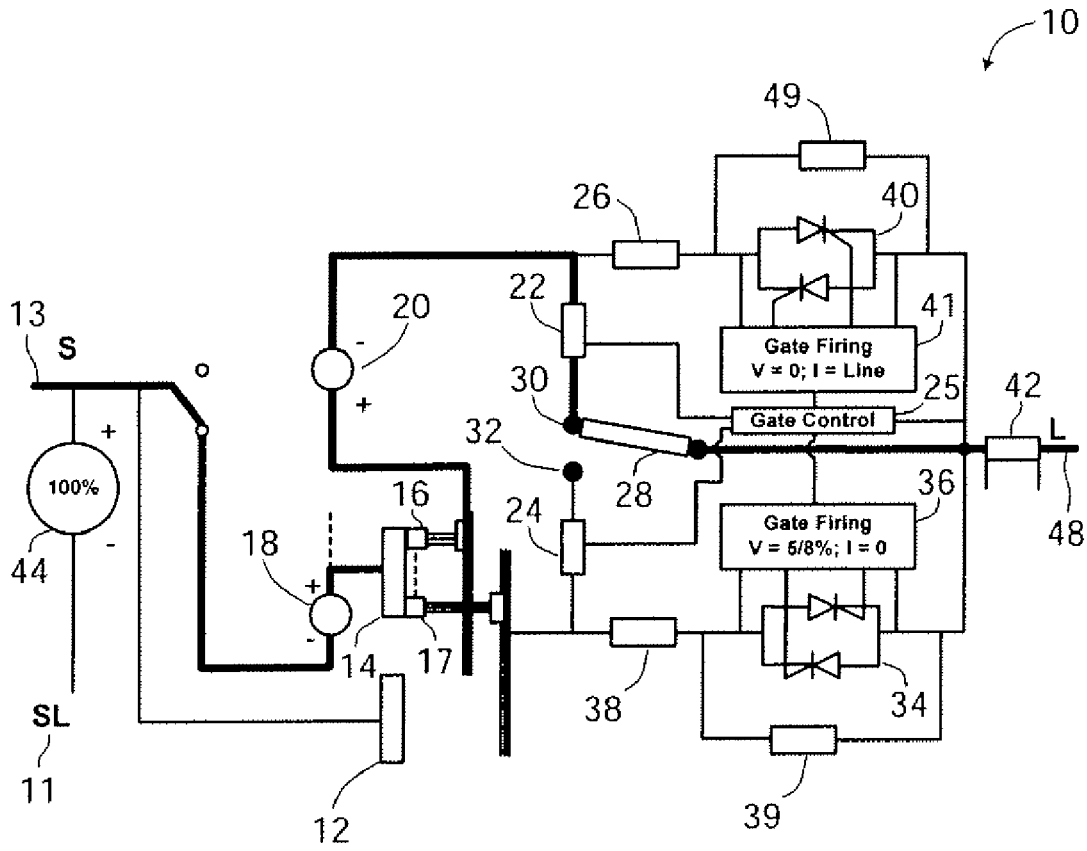
FIG. 7 illustrates an alternate position of the regulator circuit of FIG. 1.

Referring to FIG. 7, to eliminate the voltage buck or boost provided by directing load current to include the path of winding 20, current may be redirected by movement of contact 17, optionally initiated by movement of the Geneva wheel, from a floating position to contact winding 14. First thyristor pair 34 may initially remain off as the voltage (corresponding to the voltage triggering value of winding 20) is not enough to gate first thyristor pair 34 on. Switch 28 may then be moved away from second pole 30, causing a voltage across second gate trigger circuit 41 to build a voltage across the mechanical and semiconductor switches and the control which occurs after semiconductor switch 40 stops conducting. Since the second thyristor pair 40 has already been triggered on by the control responsive to the current through current transformer 22 and switch 28 in contact at pole 30, thyristor pair 40 conducts to the next current zero or for a predetermined delay, such as a period of time or a number of half cycles, after the current through 30 ends. When current stops passing through mechanical switch 28, second thyristor pair 40 stops conducting at the next current zero or for an additional predetermined delay, and the current path is momentarily maintained through snubber circuits 39 and 49 across thyristor pair 34 and 40, respectively.

Figure 8:
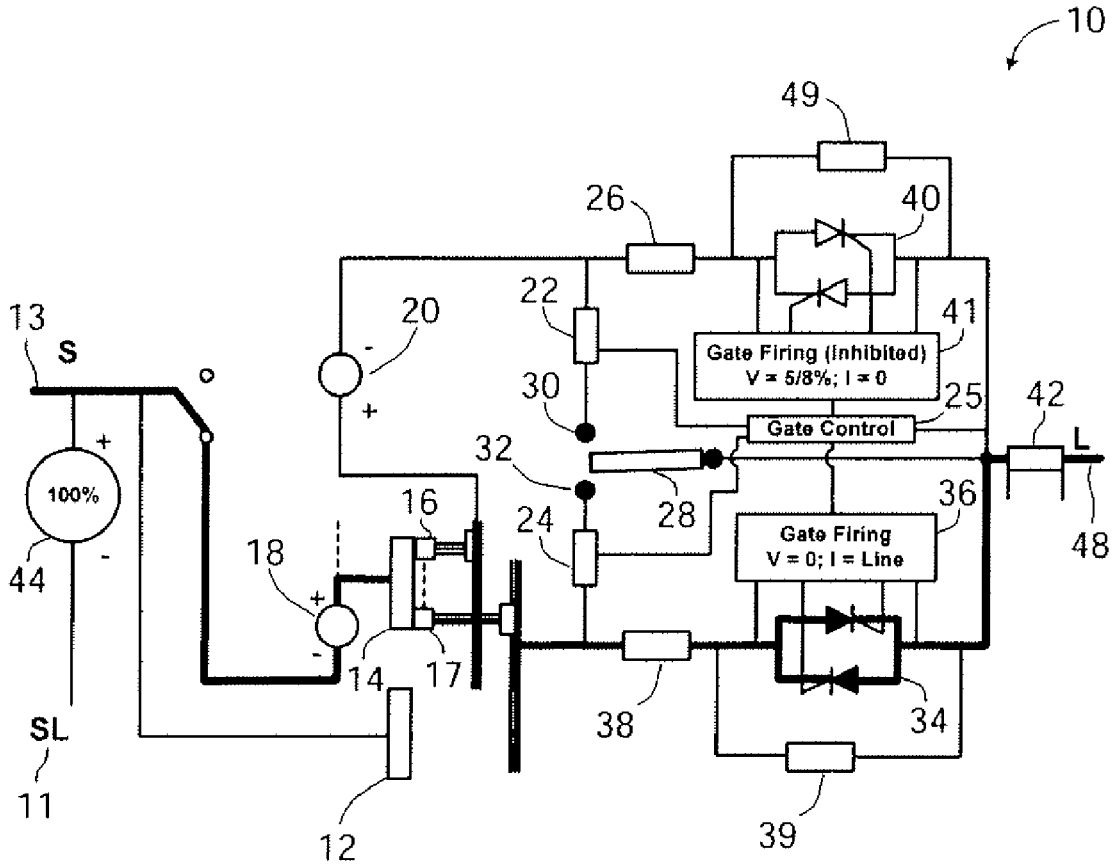
FIG. 8 illustrates an alternate position of the regulator circuit of FIG. 1.

Referring to FIG. 8, mechanical switch 28 may then be moved toward first pole 32, at which point first thyristor pair 34, triggered by voltage, will carry the load until electrical contact is made at first pole 32.

Figure 9:
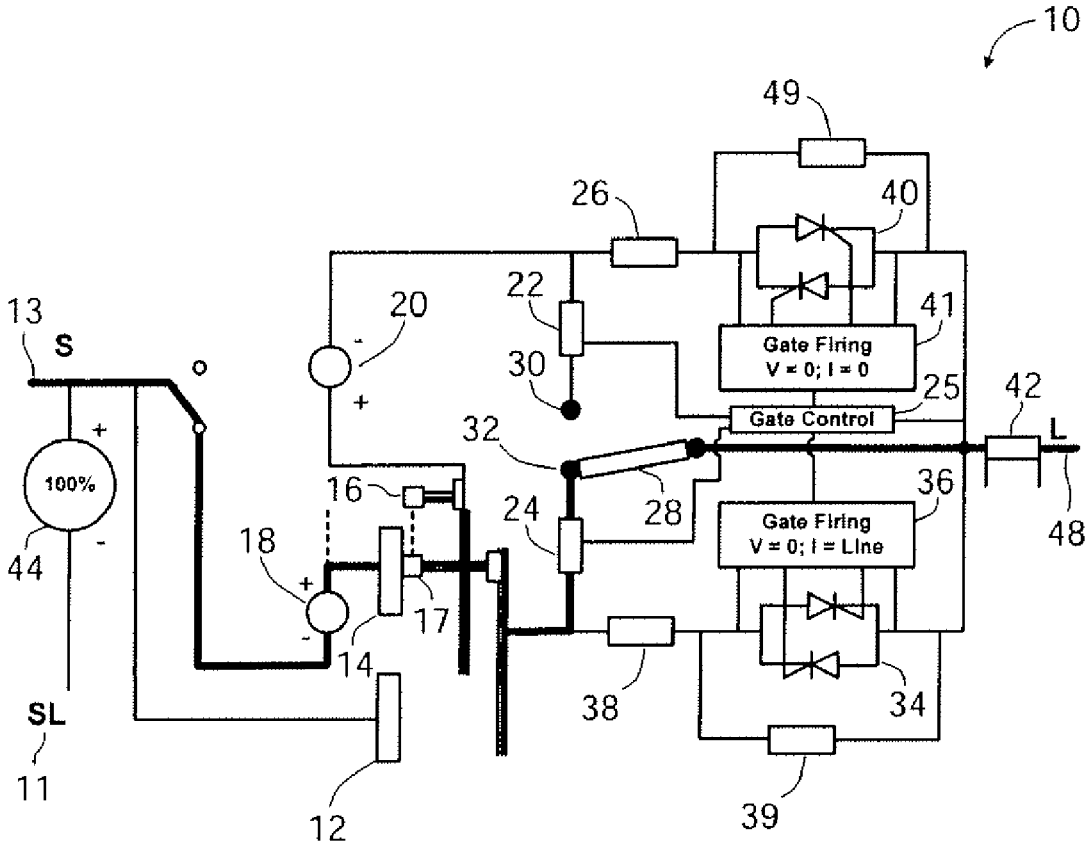
FIG. 9 illustrates an alternate position of the regulator circuit of FIG. 1.

Referring to FIG. 9, when current is shunted by way of first pole 32 through switch 28, current ceases to pass through first thyristor pair 34, and the Geneva wheel continues to turn until the second moving contact 16 moves to a floating position. Accordingly, the thyristors and associated control and trigger circuits are only powered during a tap change, which may help to improve reliability. The power for the trigger and control circuits may be derived from voltage across contact poles 30 and 32. In the quiescent state, substantially no voltage is present across those poles.

Current sensing is used to provide the selective triggering of the thyristor pair 34, which is in parallel with the then current-conducting mechanical switch 28. The removal of load current flowing through the switch 28 may cause the thyristor pair 34 to turn off based on removal of triggering from the thyristor pair 34, optionally after a short time delay to ensure that the contact separation is enough to block impressed voltage.

Voltage sensing may be provided by control 25 and the gate controls 36 and 41 with the signal that informs that there is a rapid buildup of voltage across the thyristor switches resulting from both of the contacts 30 and 32 and both thyristor pairs 34 and 40 being open. Load current must then be commutated to the second thyristor pair 40. During this time, load current flows through the thyristor snubber circuits driven by the regulator line voltage. The snubber circuits 39 and 49, each including one or more series resistors and capacitors, charge rapidly but allow enough time to ensure that the first conducting thyristor has recovered its blocking state. When this voltage reaches a certain voltage, for example 400 volts, the control 25 causes the gate trigger circuit 41 to trigger the second thyristor pair 40 to maintain a load current path. The control performs this function by using the voltage level information plus the switch 28 direction information to trigger the correct thyristor pair, which will then continue to be triggered until the mechanical switch 28 closes. Directional information about switch 28 helps to ensure that the correct semiconductor device or devices turn on. Methods of obtaining the directional information may include use of electrical signals to set an electronic latch, or to use microswitch inputs from the Geneva wheel.

Referring to FIGS. 1-9, a first fuse 38 is associated with first thyristor pair 34, and a second fuse 26 is associated with second thyristor pair 40. Thus, if any of the semiconductor devices fail and short in a current-conducting position, the associated fuse will protect the circuit.

Thus, the hybrid design embodiments described herein provide numerous advantages over the prior art. For example, a bridging reactor that would be required if a vacuum interrupter or conventional tap changers were used is not required in non-vacuum embodiments such as those described herein. Contrasted with pure solid state tap changers, fewer thyristors are required. For example, the embodiments shown in the Figures described above only require two electrical switches, each including two semiconductor devices (e.g., thyristor pairs). Unlike previous hybrid designs, in various embodiments described herein only one mechanical auxiliary switch is required, and no power resistor or other current limiting device is required. The use of gate controls which derive signals from the referenced power circuit current and voltage may improve timing accuracy. Further, the configuration described herein may substantially even out the duty requirement for each thyristor pair on alternating tap changes. For transformers with more than two taps, the circuit may simply alternate between the two thyristor pairs as the contacts move from tap to tap.

It will be appreciated that some or all of the above-disclosed and other features and functions, or alternatives thereof, may be desirably combined into many other different systems or applications. Also that various presently unforeseen or unanticipated alternatives, modifications) variations or improvements therein may be subsequently made by those skilled in the art which are also intended to be encompassed by the following claims.

What is claimed is:

1. A load tap changer, comprising:

a first semiconductor device connected to a first gate trigger circuit;

a second semiconductor device connected to a second gate trigger circuit; and a mechanical switch that shunts the first semiconductor device when the mechanical switch is in a first conducting position and shunts the second semiconductor device when the mechanical switch is in a second conducting position;

wherein the mechanical switch is in electrical contact with a first pole when the switch is in the first conducting position, and wherein the mechanical switch is in electrical contact with a second pole when the switch is in the second conducting position;

wherein the mechanical switch creates a first circuit between a source and a load through a first contact when the mechanical switch is in the first conducting position, and the mechanical switch creates a second circuit between the source and the load through a second contact when the mechanical switch is in the second conducting position;

wherein movement of the mechanical switch from the first conducting position to the second conducting position, wherein the mechanical switch contacts neither the first or second pole, causes one of the gate trigger circuits to trigger its corresponding semiconductor device and complete a circuit through the corresponding semiconductor device for effecting engagement of a transformer tap.

2. The load tap changer of claim 1, wherein:

the first semiconductor device comprises a first set of one or more semiconductive components electrically connected as a first alternating current switch; and the second semiconductor device comprises a second set of one or more semiconductive components electrically connected as a second alternating current switch.

3. The load tap changer of claim 1, wherein:

the first semiconductor device comprises a first thyristor pair; and the second semiconductor device comprises a second thyristor pair.

4. The load tap changer of claim 1, wherein the triggering is responsive to the detection of current in one of the mechanical switch conducting positions by the first or second trigger circuits.

5. The load tap changer of claim 1, wherein the mechanical switch comprises a two-pole, single throw switch and is the only mechanical switch in the circuit that is required to change from the first circuit to the second circuit.

6. The load tap changer of claim 3, wherein the first thyristor pair and the second thyristor pair comprise the only thyristor pairs that are required to change from the first circuit to the second circuit.

7. The load tap changer of claim 1 further comprising a gate control that initiates a gate signal to control the first gate trigger circuit or the second gate trigger circuit in response to sensed current traveling through a current transformer that is in electrical connection with the first or second pole respectively.

8. A load tap changer, comprising:

a single mechanical switch that is movable to create, in a first position, a first conducting path between a first transformer winding and a load, and in a second position a second conducting path between a second transformer winding and the load;

wherein the mechanical switch is in electrical contact with a first pole when the switch is in the first position, and the mechanical switch is in electrical contact with a second pole when the switch is in the second position;

a first thyristor pair that creates a first alternate conducting path between the first transformer tap and the load when the switch is disengaged from the first position and not in contact with either the first pole or the second pole; and a second thyristor pair that creates a second alternate conducting path between the second transformer tap and the load when the mechanical switch is disengaged from the second position and not in contact with either the first pole or the second pole.

9. The load tap changer of claim 8, further comprising a gate trigger circuit for each thyristor pair.

10. The load tap changer of claim 8, further comprising a gate control circuit that controls each of the gate trigger circuits.

11. The load tap changer of claim 8, wherein no current limiting device is required to be connected in the circuit.

12. The load tap changer of claim 8, wherein during long-term operation, each thyristor pair receives substantially the same level of duty.

13. The load tap changer of claim 8, wherein the mechanical switch comprises a two-pole, single-throw switch.

14. The load tap changer of claim 8, further comprising:

a Geneva wheel, a first moving contact, and a second moving contact;

wherein the Geneva wheel initiates movement of the first moving contact toward or away from the first transformer tap, and the Geneva wheel also initiates movement of the second moving contact toward or away from the second transformer tap.

15. The load tap changer of claim 8, further comprising:

a first snubber circuit in parallel with the first thyristor pair; and a second snubber circuit in parallel with the second thyristor pair.

16. A method of delivering power to a load, comprising:

operating a circuit having a mechanical switch in a first conducting position, and a first moving contact in electrical connection with a first winding of a transformer, so that the mechanical switch and first moving contact create a first circuit between a source and a load;

moving a second contact to create an electrical connection between the second contact and a second winding of the transformer;

moving the mechanical switch away from the first conducting position and toward a second conducting position;

in response to a gate control signal that was initiated in response to sensed current in a first current transformer, causing the first gate trigger circuit to apply a first trigger to a first semiconductor device to complete a circuit between the source and the load through the first semiconductor device;

causing the first gate trigger circuit to remove the first trigger from the first semiconductor device so that the first semiconductor device stops conducting;

in response to a gate control signal that was initiated in response to sensed voltage level across either semiconductor device, causing the second gate trigger circuit to trigger a second semiconductor device to complete a circuit between the source and the load through the second semiconductor device; and when the mechanical switch reaches the second conducting position, creating a second circuit between the source and the load by shunting the second semiconductor device and passing current through the mechanical switch.

17. The method of claim 16, further comprising maintaining a continuous current path to the load as the mechanical switch moves from the first conducting position to the second conducting position.

18. The method of claim 16, wherein causing the first gate trigger circuit to remove the first trigger from the first semiconductor device is responsive to occurrence of a current zero through the mechanical switch.

19. The method of claim 16, wherein the triggering and conduction of the second semiconductor device is responsive to voltage across either the first semiconductor device or the second semiconductor device exceeding a peak operating voltage of a winding of the transformer.

20. The load tap changer of claim 8, further comprising a gate control circuit that controls a corresponding gate trigger circuit.

* * * * *